US008893414B1

(12) United States Patent
Zachorne

(10) Patent No.: US 8,893,414 B1
(45) Date of Patent: Nov. 25, 2014

(54) ILLUMINATION CONTROL DEVICE

(71) Applicant: Dominic D. Zachorne, Wickford, RI (US)

(72) Inventor: Dominic D. Zachorne, Wickford, RI (US)

( * ) Notice: Subject to any disclaimer, the term of this patent is extended or adjusted under 35 U.S.C. 154(b) by 11 days.

(21) Appl. No.: 14/076,476

(22) Filed: Nov. 11, 2013

(51) Int. Cl.
*G09F 21/12* (2006.01)
*G09F 13/14* (2006.01)

(52) U.S. Cl.
CPC ..... *G09F 13/14* (2013.01)
USPC ..... 40/555; 40/572

(58) Field of Classification Search
USPC ..... 40/541, 564, 572, 612, 555; 362/186, 362/208, 347, 812, 23.13, 23.2
See application file for complete search history.

(56) References Cited

U.S. PATENT DOCUMENTS

| | | | | |
|---|---|---|---|---|
| 1,430,147 | A | 9/1922 | Beville | |
| 1,796,694 | A * | 3/1931 | Silva | 40/572 |
| 1,931,577 | A * | 10/1933 | Easterday et al. | 40/572 |
| 4,561,203 | A | 12/1985 | MacDonald, Jr. et al. | |
| 5,188,453 | A | 2/1993 | Subisak et al. | |
| 5,365,411 | A | 11/1994 | Rycroft et al. | |
| 5,428,912 | A * | 7/1995 | Grondal et al. | 40/570 |
| 5,664,878 | A | 9/1997 | Subisak et al. | |
| 5,950,340 | A | 9/1999 | Woo | |
| 8,049,951 | B2 | 11/2011 | Gruhlke et al. | |
| 2012/0163022 | A1 | 6/2012 | Bakker et al. | |

FOREIGN PATENT DOCUMENTS

| | | | |
|---|---|---|---|
| GB | 2123065 | A * | 1/1984 |
| JP | 2002069946 | A * | 3/2002 |

* cited by examiner

*Primary Examiner* — Casandra Davis
(74) *Attorney, Agent, or Firm* — Salter & Michaelson

(57) ABSTRACT

An illumination control device includes a housing having opposed illumination surfaces for the respective display of opposed visual messages. The housing further including a light inlet port for coupling light from a light source, and the housing constructed and arranged to form an enclosed light chamber. The device further includes a pair of oppositely directed arcuate reflective surfaces joined at a common light inlet edge, with the pair of oppositely directed arcuate reflective surfaces disposed in the enclosed light chamber and in line with the housing light inlet port.

9 Claims, 7 Drawing Sheets

ILLUMINATION CONTROL DEVICE

FIELD OF THE INVENTION

The present invention relates in general to an illumination control device and pertains, more particularly, to an improvement in such devices particularly where opposed direction visual messages are to be displayed.

BACKGROUND OF THE INVENTION

There presently exists both internally and externally illuminated signs. One example is illustrated in U.S. Pat. No. 5,188,453 to Subisak et al. This describes an internally illuminated sign. This prior art does not address signage in which there are opposed visual messages to be displayed.

In the prior art a sign box is described in U.S. Pat. No. 5,950,340 to Woo. This device describes a light permeable box body that is v-shaped. However, this construction does not optimize the light output.

Accordingly, it is an object of the present invention to provide an improved illumination control device and one that is, in particular, constructed to provide opposed visual messages on a housing.

Still another object of the present invention is to provide an illumination control device that is adapted to bifurcate an incoming light beam so as to distribute the light substantially equally onto a back-to-back reflective surfaces.

Another object of the present invention is to provide an improved illumination control device that is relatively simply in construction, that can be manufactured relatively inexpensively and that is easy to use and operate.

SUMMARY OF THE INVENTION

To accomplish the foregoing and other objects, features and advantages of the present invention there is provided an illumination control device, comprising:

a housing having opposed illumination surfaces for the respective display of opposed visual messages;

said housing further including a light inlet port for coupling light from a light source;

said housing constructed and arranged to form an enclosed light chamber; and a pair of oppositely directed arcuate reflective surfaces joined at a common light inlet edge;

said pair of oppositely directed arcuate reflective surfaces disposed in said enclosed light chamber and in line with said housing light inlet port.

In accordance with other aspects of the present invention the opposed illumination surfaces include opposed walls of the housing; each visual message is formed by providing an indicia carving through each wall; the housing has a peripheral sidewall that partially defines the enclosed light chamber and having the light inlet port disposed in the peripheral sidewall; the light inlet port is cylindrical and the light source is a flashlight; the light inlet port is formed by an external collar that matingly receives an illumination end of the flashlight; the common inlet edge of the arcuate reflective surfaces is spaced inward of the illumination end of the flashlight; each pair of oppositely directed arcuate reflective surfaces has at least a partially parabolic curvature; and each of the pair of oppositely directed arcuate reflective surfaces has a side remote from the common inlet edge that is closer to the illumination surface of the housing than is the common inlet edge.

In another version of the present invention there is provided an illumination apparatus for receiving a light source for the purpose of illuminating display surfaces, said apparatus comprising:

a housing having opposed and spaced apart illumination surfaces for the respective display of opposed visual messages;

said housing constructed and arranged to form an enclosed light chamber;

said housing further including a light inlet port for coupling light from a light source into the enclosed light chamber;

a pair of oppositely directed reflective members, each member having an inlet side and a reflective outlet surface side;

said pair of oppositely directed reflective members disposed in said enclosed light chamber and in line with said housing light inlet port with the inlet side thereof disposed adjacent to and for receiving light from the light source;

whereby light from the light source coupled at the light inlet port is bifurcated by the pair of oppositely directed reflective members and re-directed by the pair of oppositely directed reflective members to the respective opposed and spaced apart illumination surfaces of the housing.

In accordance with still other aspects of the present invention the illumination surfaces include opposed walls of the housing, and each visual message is formed by providing a visual indicia at each wall; the housing has a peripheral sidewall that partially defines the enclosed light chamber and having the light inlet port disposed in the peripheral sidewall, the light inlet port is cylindrical and the light source is a flashlight; the light inlet port is formed by an external collar that matingly receives an illumination end of the flashlight, the common inlet edge of the reflective surfaces is spaced inward of the illumination end of the flashlight; each pair of oppositely directed reflective surfaces has at least a partially arcuate curvature; the pair of oppositely directed reflective surfaces are joined at respective inlet sides thereof at a common light inlet edge; the illumination surfaces include opposed walls of the housing and the common light inlet edge extends substantially parallel to both opposed walls; each of the pair of oppositely directed reflective surfaces has the reflective outlet surface side remote from the common inlet edge and that is closer to the illumination surfaces of the housing than is the common inlet edge; and both of the pair of oppositely directed reflective surfaces has at least a partially parabolic curvature.

In accordance with another embodiment of the present invention there is provided a method of illuminating a display that includes a display housing having opposed and spaced apart illumination surfaces for the respective display of opposed visual messages. This method comprises, directing a light beam into the housing through a light inlet port of the housing, bifurcating the light beam by means of the light beam being directed against a pair of oppositely directed reflective members, each member having an inlet side and a reflective outlet surface side, the bifurcated light beam being re-directed by the pair of oppositely directed reflective members to the respective opposed and spaced apart illumination surfaces of the housing. The bifurcation preferably causes the respective re-directed light beams to be directed substantially orthogonal to the initial direction of the light beam entering the housing.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 1:
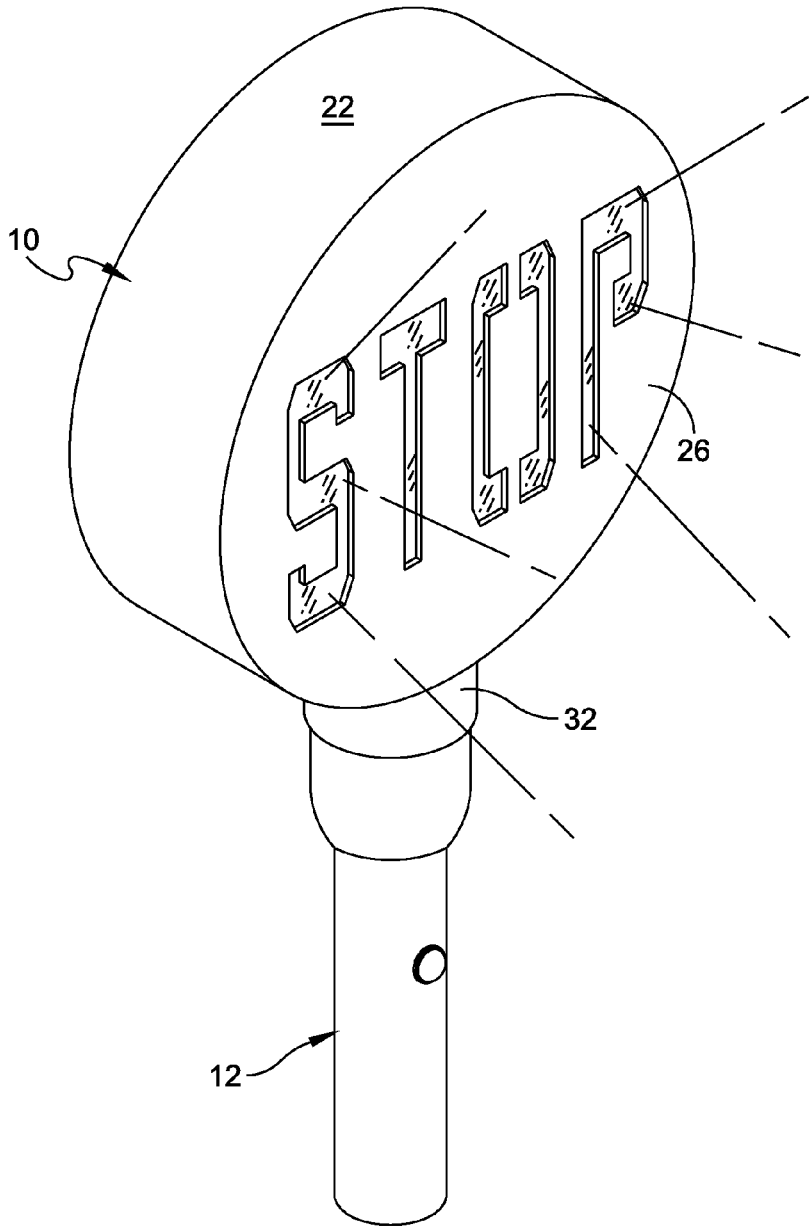
FIG. 1 is a front perspective view of one embodiment of the illumination control device of the present invention.
Figure 2:
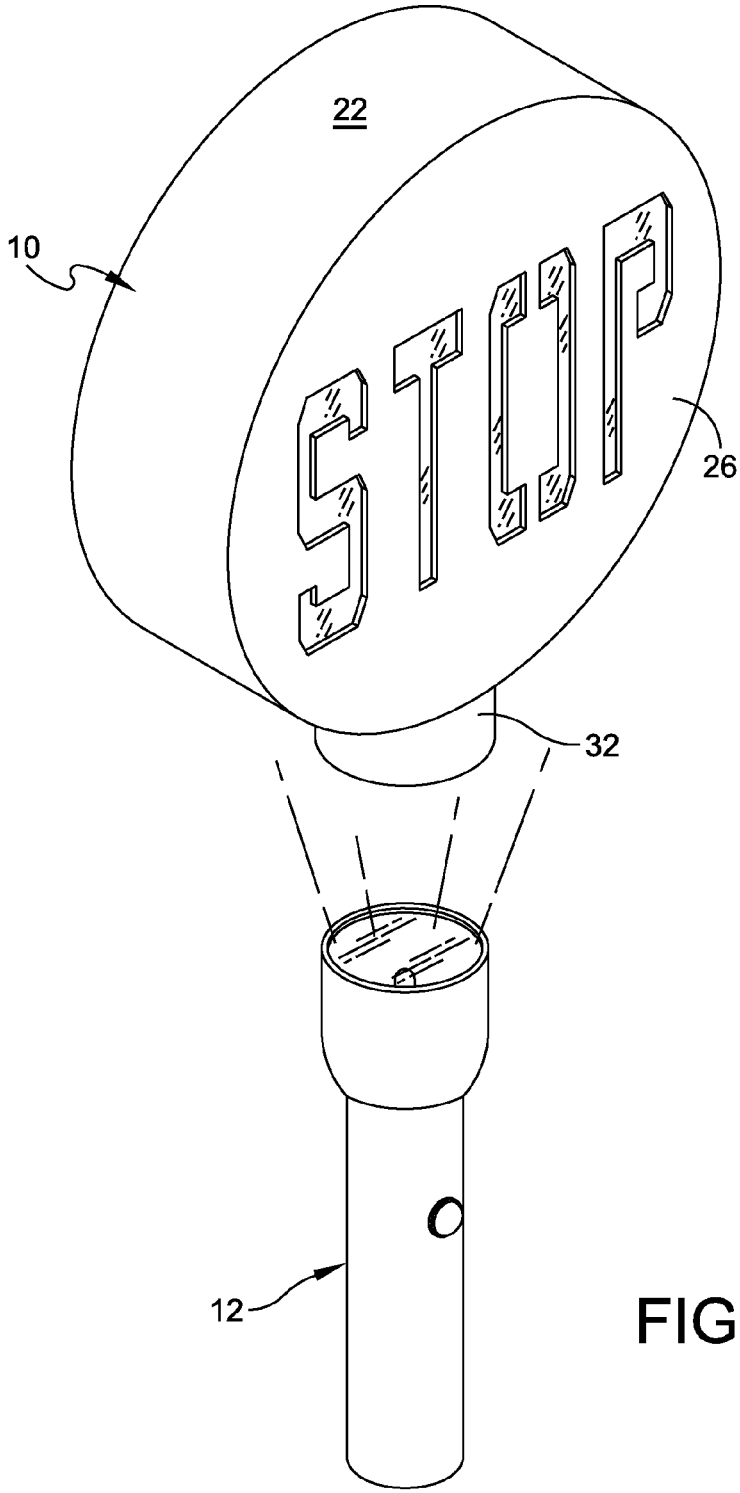
FIG. 2 is a perspective view similar to that illustrated in FIG. 1 and showing the light source or flashlight exploded away from the signage.
Figure 3:
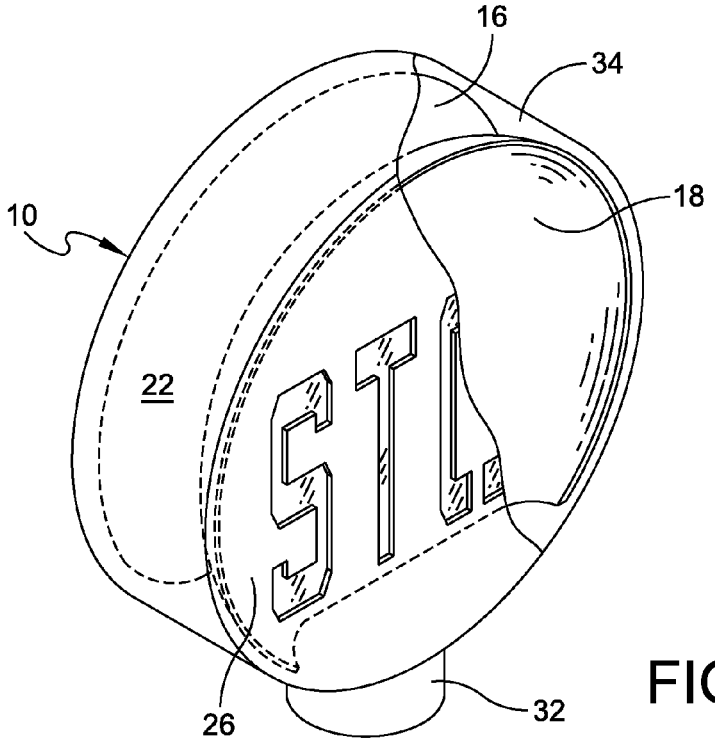
FIG. 3 is a perspective view of the illumination control device on one side thereof and with the housing partially cut away to expose the internal reflective surfaces.
Figure 4:
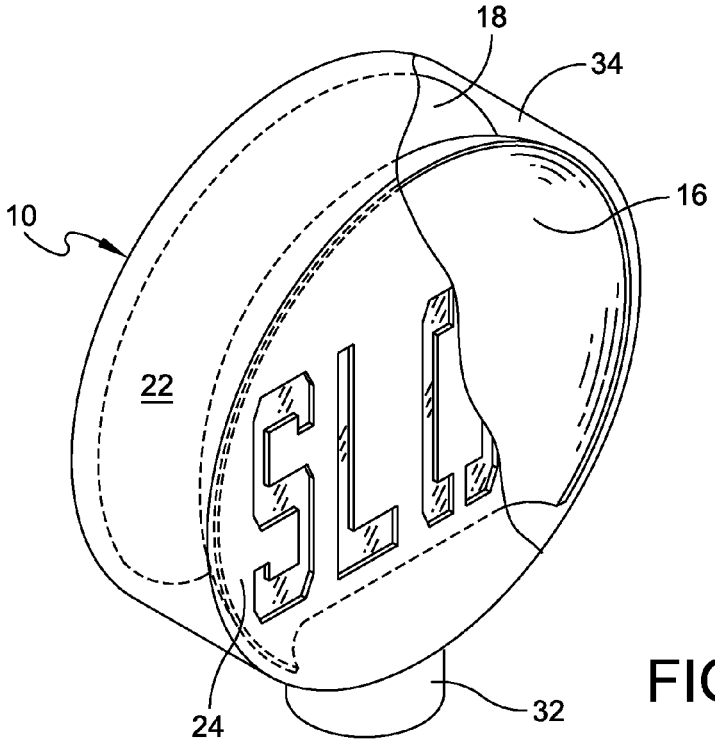
FIG. 4 is a perspective view of the illumination control device on the other side thereof and with the housing partially cut away to expose the internal reflective surfaces.
Figure 5:
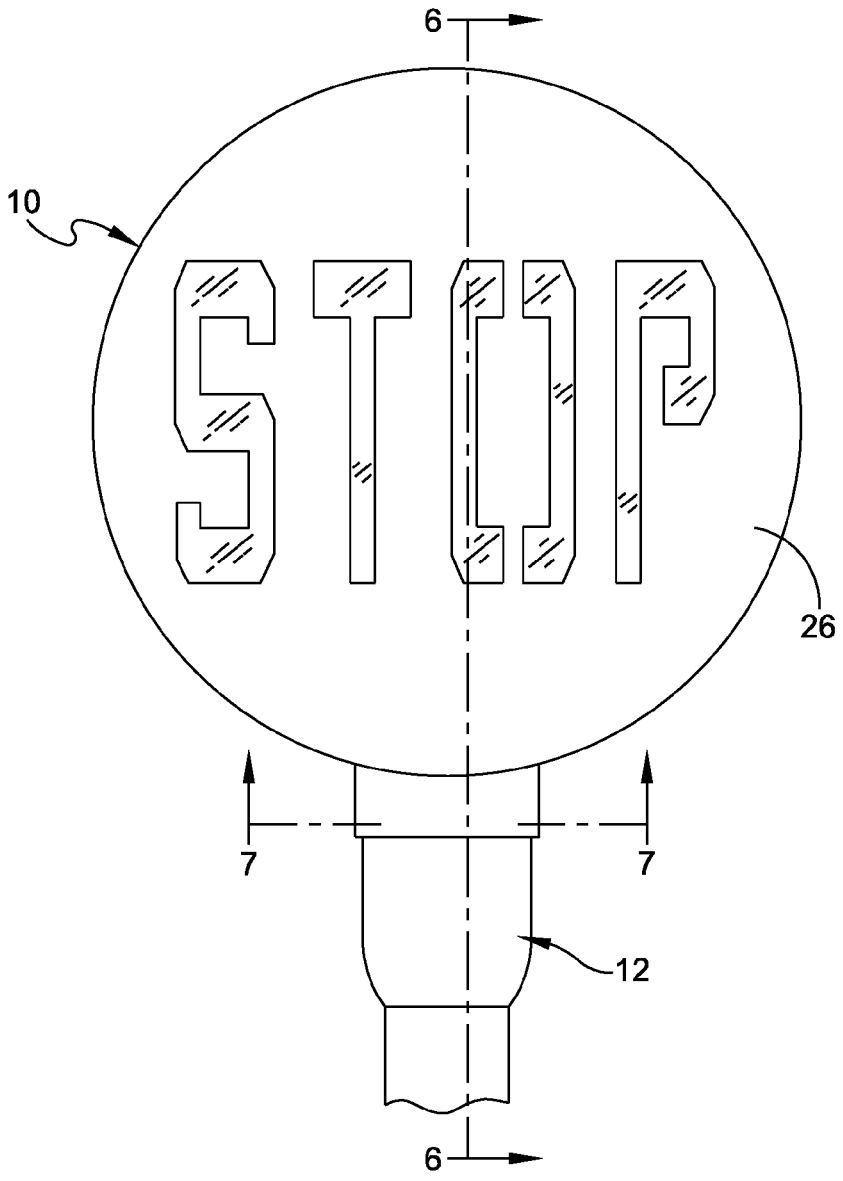
FIG. 5 is a front view of the illumination control device of the present invention.

The illumination control device of the present invention is described herein in a limited number of embodiments. However, it is understood that the concepts of the present invention can be applied in many different embodiments for displaying many different forms of visual messages or images. One purpose of the device of the present invention is to provide an illumination housing 10 that may display in opposed opposite sides different messages. The disclosed embodiment illustrates the messages "stop" and "slow." Other messages or images may also be employed. Also, the particular housing that is described herein is substantially cylindrical in shape. In accordance with the present invention, other shapes of housings could be used including rectangular, square, trapezoidal and other geometric shapes.

In the embodiments illustrated herein, one of the elements is the provision for a light source. In the illustrated embodiments this light source is represented by a flashlight 12. However, in other embodiments of the invention, other forms of light source may be used for directing light into the housing 10.

As indicated previously, the device of the present invention bifurcates an input light beam. In this regard, reference is made to the cross-sectional view of FIG. 6 that shows the bifurcated beam by means of the dotted arrows 14. The device of the present invention essentially splits the light beam, preferably equally, directing the light on to two contoured reflectors 16 and 18. These reflectors redirect the light through the housing as also illustrated by dotted arrows 20 in FIG. 6.

Figure 6:
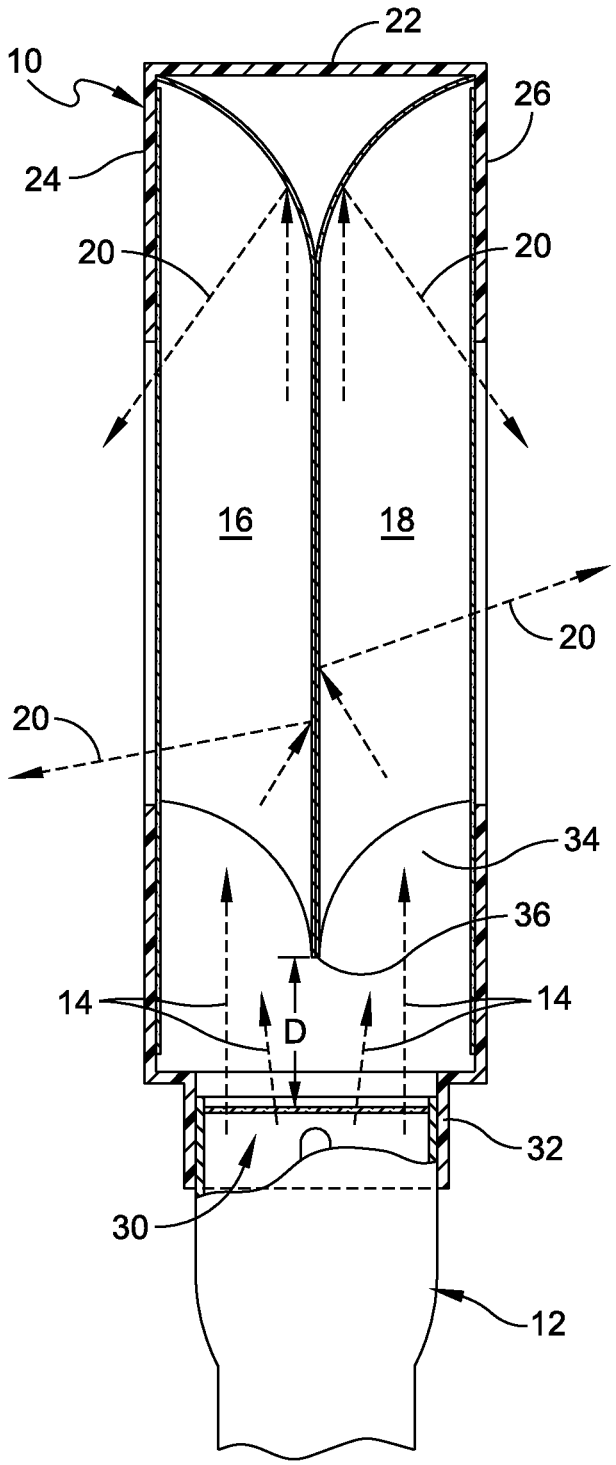
FIG. 6 is a cross-sectional view taken along line 6-6 of FIG. 5 for an illustration of one embodiment of the opposed reflective surfaces.
Figure 7:
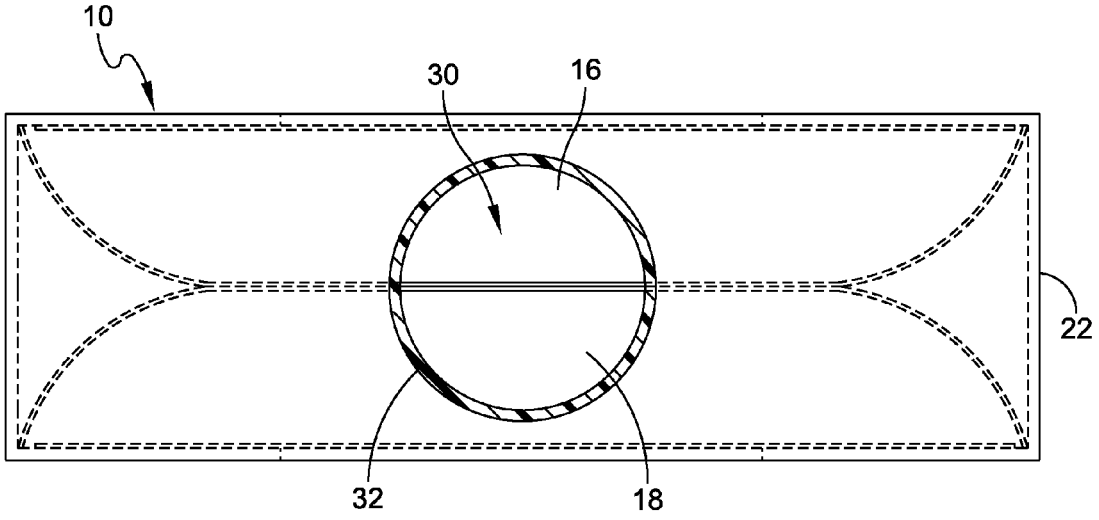
FIG. 7 is a cross-sectional view taken at the light inlet port.

In the illustrated embodiment, the housing 10 has a peripheral wall 22 that supports opposed illumination surfaces 24 and 26. The housing 10 further includes a light inlet port 30. In this regard refer to the cross-sectional view of FIG. 7. The flashlight 12 is engaged in the port 30 for coupling light from the flashlight into the housing. In this regard the light inlet port is cylindrical formed by an external collar 32 that matingly receives an illumination end of the flashlight. The collar 32 may be slightly tapered to a slightly greater inner diameter at its free end so that the flashlight is readily inserted into the collar but, once inserted a certain distance, will be firmly held by the collar 32. The housing 10 is constructed and arranged to form an enclosed internal light chamber 34. The pair of oppositely directed arcuate reflective surfaces 16 and 18 are joined at a common light inlet edge 36, although, in other embodiments of the present invention these reflectors need not necessarily be joined at that location. The pair of oppositely directed arcuate reflective surfaces are also disposed in line with the housing light inlet port 30, as clearly illustrated in the cross-sectional view of FIG. 6. Again, refer to the arrows 14 in FIG. 6 showing the manner in which the light beam from the flashlight is bifurcated with preferably half of the light beam being directed to each of the respective reflector surfaces. Thus, light from the light source or flashlight is coupled at the light inlet port, it is then bifurcated by the pair of oppositely directed reflective members and is redirected (arrows 20 in FIG. 6) by the pair of oppositely directed reflective members to the respective opposed and spaced apart illumination surfaces 24, 26 of the housing. As also illustrated in FIG. 6, the edge 36 of the reflective surfaces is preferably spaced relatively short distance from the top end of the flashlight. This is illustrated in FIG. 6 by the dimension D. This spacing may be on the order of 1-2 inches or approximately at 1½ inches.

Each of the reflective surfaces 16, 18 is preferably at least partially parabolic. Thus, each of these reflective surfaces has a side remote from the common inlet edge 36 that is closer to a corresponding illumination surface than is the common inlet edge. In the cross-sectional view of FIG. 6 at the remote side of each of the reflective surfaces, these reflective surfaces bend to meet their respective housing illumination surfaces 24, 26.

Figure 8:
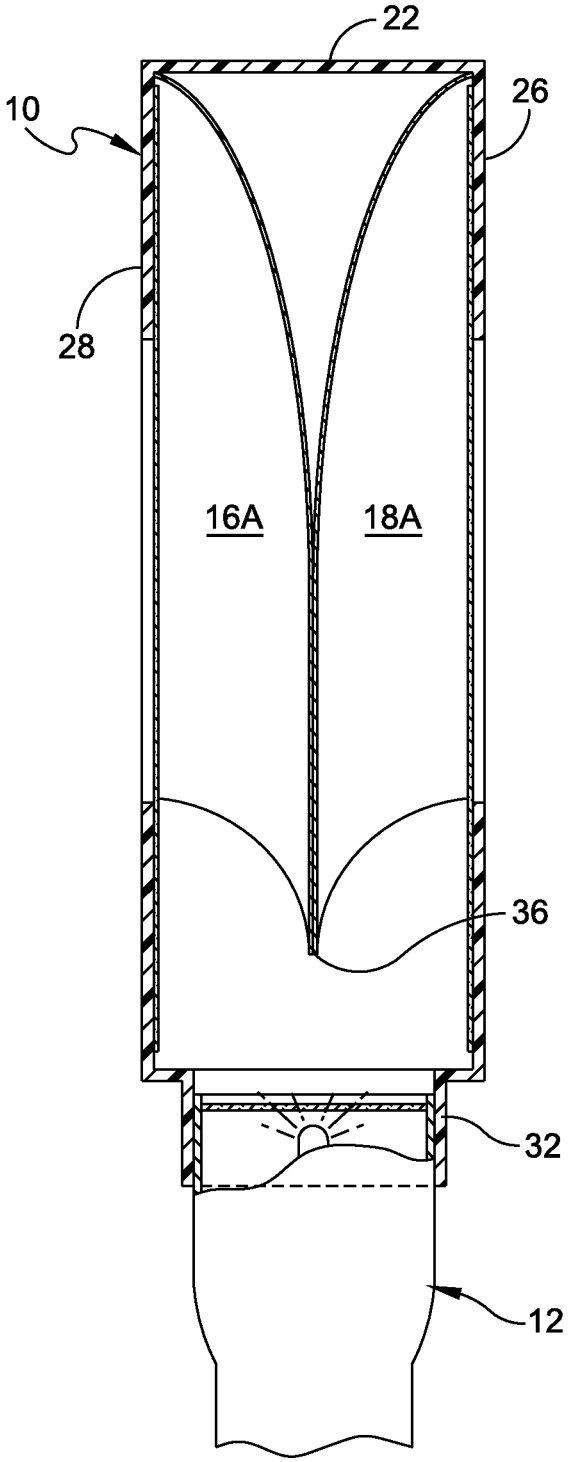
FIG. 8 is a cross-sectional view similar to that illustrated in FIG. 6 but showing a somewhat different construction of the reflective surfaces.

FIG. 6 is a cross-sectional view of one embodiment of the present invention in which the reflective surfaces 16 and 18 have a relatively straight section along a length and then terminate in a parabolic section. The cross-sectional view of FIG. 8 shows a slightly different configuration in which the reflective surfaces 16A and 18A sweep in a greater length curvature with these surfaces formed essentially tangentially along an elongated center line and sweeping to the outer edges at walls 26 and 28.

In accordance with another aspect of the present invention, there is provided a method of illuminating a display in which there is provided a display housing having opposed and spaced apart illumination surfaces, such as the surfaces or walls 26 and 28 depicted in the drawings. These surfaces are for the respective display of opposed visual messages or images. As indicated previously, these messages or images can take on many different forms. This method includes directing a light beam into the housing through a light inlet port of the housing. This light beam is bifurcated by means of the light beam being directed against a pair of oppositely directed reflective members. Each member has an inlet side and a reflective outlet surface side. The bifurcated light beam is redirected by the pair of oppositely directed reflective members 16, 18 to the respective opposed and spaced apart illumination surfaces 26, 28 of the housing. The bifurcation causes the respective redirected light beams to be directed substantially orthogonal to the initial direction of the light beam entering the housing. This somewhat orthogonal direction is illustrated by respective arrows 14 and 20 in FIG. 6.

The illumination control device of the present invention can be constructed of a number of different types of materials, but preferably is constructed of a plastic material. Although a limited number of embodiments are described herein, it is understood that multiple other embodiments are considered as falling within the scope of the present invention. This includes embodiments relating to the shape of the housing, the particular message or image displayed, and the light source employed.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. An illumination apparatus in combination with a light source that illuminates display surfaces of the illumination apparatus, said illumination apparatus comprising:

a housing having opposed and spaced apart illumination surfaces for the respective display of opposed visual messages;

said housing constructed and arranged to form an enclosed light chamber;

said housing further including a light inlet port for coupling light from a light source into the enclosed light chamber;

said light inlet port is cylindrical;

said light source including a cylindrical illumination head end;

said light inlet port is formed by an external cylindrical collar that matingly receives the cylindrical illumination head end of the light source and that has a longitudinal center axis extending into the enclosed light chamber;

said cylindrical collar having an open cylindrical free end for releasably engaging and matingly receiving the cylindrical illumination head end of the light source within an inner diameter cylindrical surface of the cylindrical collar;

a pair of oppositely directed reflective members, each member having an inlet side and a reflective outlet surface side;

said inlet side of the respective reflective members being joined at a common light inlet edge;

said common inlet edge of the reflective members is spaced inward into the enclosed light chamber and is spaced from the cylindrical illumination head end of the light source so as to define between the cylindrical illumination head end of the light source and the common inlet edge of the reflective members an open gap;

said pair of oppositely directed reflective members disposed in said enclosed light chamber and in line with said housing light inlet port longitudinal axis with the inlet side thereof disposed adjacent to and for receiving light from the light source;

each said reflective member at the inlet side thereof including a linear portion where the reflective members are connected and extend substantially linearly along the longitudinal center axis of the light inlet port, and at the outlet side thereof including a parabolic portion contiguous with the linear portion whereby light from the light source coupled at the light inlet port is bifurcated by the pair of oppositely directed reflective members and re-directed by the pair of oppositely directed reflective members to the respective opposed and spaced apart illumination surfaces of the housing.

2. The illumination apparatus of claim 1 wherein said illumination surfaces include opposed walls of the housing, and each visual message is formed by providing a visual indicia at each wall.

3. The illumination apparatus of claim 1 wherein said housing has a peripheral sidewall that partially defines the enclosed light chamber and having the light inlet port disposed in the peripheral sidewall, and the light source is a flashlight.

4. The illumination apparatus of claim 1 wherein the light source is a flashlight and the cylindrical collar has an inner tapered surface that has a greater inner diameter at its open cylindrical free end so that the flashlight is readily insertable into the collar but, once inserted a predetermined distance, is firmly held by the cylindrical collar.

5. The illumination apparatus of claim 1 wherein said housing has a circular peripheral sidewall that partially defines the enclosed light chamber and having the cylindrical collar disposed in the circular peripheral sidewall.

6. The illumination apparatus of claim 5 wherein the cylindrical collar is centered from said to side in the circular peripheral sidewall.

7. The illumination apparatus of claim 6 wherein a depth of the cylindrical collar is substantially the same as the distance between the cylindrical peripheral wall at the cylindrical collar and the common light inlet edge.

8. The illumination control device of claim 7 wherein the light source is a flashlight and the cylindrical collar has an inner tapered surface that has a greater inner diameter at its open cylindrical free end so that the flashlight is readily insertable into the collar but, once inserted a predetermined distance, is firmly held by the cylindrical collar.

9. The illumination apparatus of claim 8 wherein the linear portion of the reflective member extends a greater distance than the parabolic portion.

* * * * *